US005876004A

United States Patent [19]

Ralph

[11] Patent Number: 5,876,004

[45] Date of Patent: Mar. 2, 1999

[54] FURNITURE SUPPORTING SYSTEM

[76] Inventor: Ken Ralph, 3269 Maddux Dr., Palo Alto, Calif. 97303-4036

[21] Appl. No.: 891,400

[22] Filed: Jul. 10, 1997

[51] Int. Cl.[6] ..... F16M 11/00

[52] U.S. Cl. ..... 248/201; 248/220.21; 248/235

[58] Field of Search ..... 248/235, 250, 248/201, 207, 475.1, 220.21, 220.22, 229.2, 635; 108/42, 152, 48; 312/245

[56] References Cited

U.S. PATENT DOCUMENTS 2,219,975 6/1940 Bentz ..... 248/220.1

2,840,243 6/1958 Brinker et al. ..... 108/152

4,429,850 2/1984 Weber et al. ..... 248/250

*Primary Examiner*—Leslie A. Braun

*Assistant Examiner*—Gwendolyn Baxter

[57] ABSTRACT

A furniture supporting assembly is provided including a slot structure situated between the piece of furniture and a wall for providing a slot that is elongated in a horizontal direction and has a rectilinear cross-section. Also included is a protrusion structure situated between the piece of furniture and the wall for providing a protrusion that is elongated in the horizontal direction and has a rectilinear cross-section. As such, the elongated protrusion may be removably situated within the elongated slot for supporting the piece of furniture on the wall.

4 Claims, 2 Drawing Sheets

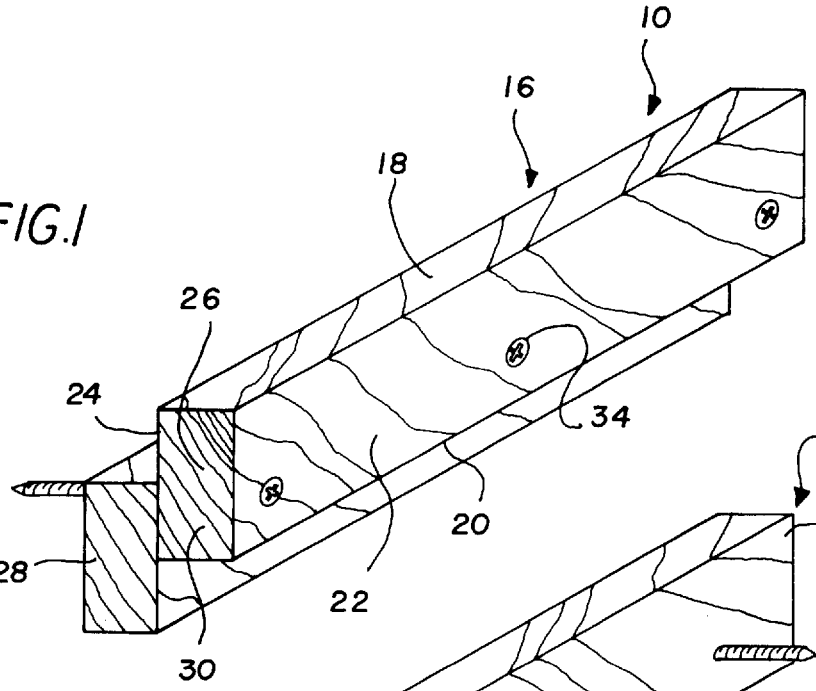
FIG.1
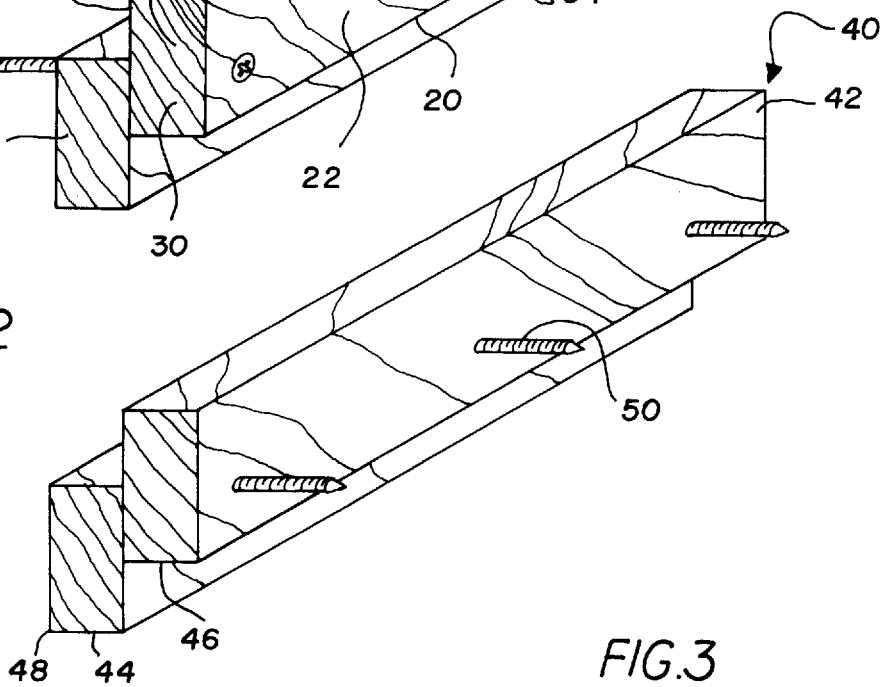
FIG. 2
FIG.3
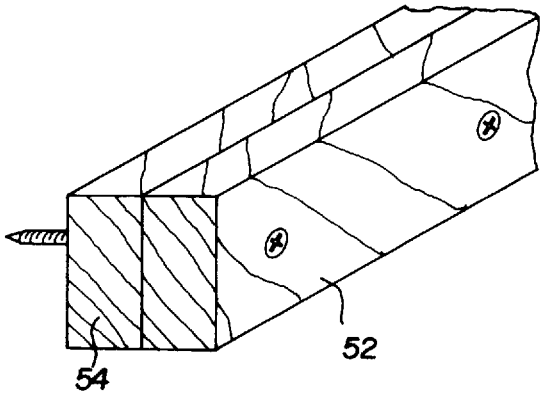

18
26
32
24
20
34
30
20
28
42
40
50
46
44
48

11
40
14
10

16
12
52

FURNITURE SUPPORTING SYSTEM

BACKGROUND OF THE INVENTION

1. Field of the Invention

The present invention relates to shelf mounts and more particularly pertains to a new FURNITURE SUPPORTING SYSTEM for supporting a piece of furniture on a wall in a secure manner.

2. Description of the Prior Art

The use of shelf mounts is known in the prior art. More specifically, shelf mounts heretofore devised and utilized are known to consist basically of familiar, expected and obvious structural configurations, notwithstanding the myriad of designs encompassed by the crowded prior art which have been developed for the fulfillment of countless objectives and requirements.

Known prior art shelf mounts include U.S. Pat. No. 4,620,684; U.S. Pat. No. 4,270,821; U.S. Pat. No. 4,527,762; U.S. Pat. No. 4,783,035; U.S. Pat. No. 4,189,123; and U.S. Pat. Des. 267,606.

In these respects, the FURNITURE SUPPORTING SYSTEM according to the present invention substantially departs from the conventional concepts and designs of the prior art, and in so doing provides an apparatus primarily developed for the purpose of supporting a piece of furniture on a wall in a secure manner.

SUMMARY OF THE INVENTION

In view of the foregoing disadvantages inherent in the known types of shelf mounts now present in the prior art, the present invention provides a new FURNITURE SUPPORTING SYSTEM construction wherein the same can be utilized for supporting a piece of furniture on a wall in a secure manner.

The general purpose of the present invention, which will be described subsequently in greater detail, is to provide a new FURNITURE SUPPORTING SYSTEM apparatus and method which has many of the advantages of the shelf mounts mentioned heretofore and many novel features that result in a new FURNITURE SUPPORTING SYSTEM which is not anticipated, rendered obvious, suggested, or even implied by any of the prior art shelf mounts, either alone or in any combination thereof.

To attain this, the present invention generally comprises a shelf with a vertical back plate. As shown in FIG. 5, the vertical back plate has a front surface and a rear surface with a periphery formed therebetween defined by a top edge, a bottom edge, and a pair of side edges. The shelf further has a plurality of horizontal members coupled to the front surface thereof at different elevations. Such horizontal member extends outwardly to afford a supporting a surface. As shown in FIG. 1, a first mounting assembly is provided with a pair of elongated members. The pair of elongated members each have a rectilinear configuration with a top face, a bottom face, a front face, a rear face, and a pair of ends. It should be noted that the front and rear face have a height twice a depth of the top and bottom face. The pair of elongated members comprise first elongated member and a second elongated member. The front face of the first elongated member is coupled to the rear face of the second elongated member such that the first elongated member is vertically offset from the second elongated member. Such interconnection defines an upper elongated slot having a square cross-section. The rear face of the first elongated member is screwably coupled to a wall and is horizontally oriented thereon, as shown FIG. 5. Associated therewith is a second mounting assembly including a pair of elongated members each having a rectilinear configuration. Note FIG. 2. Similar to the elongated members of the first mounting assembly, each has a top face, a bottom face, a front face, a rear face, and a pair of ends. Further, the front and rear face have a height twice a depth of the top and bottom face. The pair of elongated members comprise a first elongated member and a second elongated member with the front face of the first elongated member coupled to the rear face of the second elongated member. As shown in the Figures, the first elongated member is vertically offset from the second elongated member thereby defining an elongated downwardly extending protrusion having a square cross-section. The front face of the second elongated member is screwably coupled to the rear surface of the back plate of the shelf and is horizontally oriented thereon. By this structure, the elongated protrusion of the second mounting assembly may be removably situated within the elongated slot of the first mounting assembly for supporting the shelf on the wall. Finally, an elongated spacer is situated between the rear surface shelf and the wall adjacent the bottom edge thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new FURNITURE SUPPORTING SYSTEM apparatus and method which has many of the advantages of the shelf mounts mentioned heretofore and many novel features that result in a new FURNITURE SUPPORTING SYSTEM which is not anticipated, rendered obvious, suggested, or even implied by any of the prior art shelf mounts, either alone or in any combination thereof.

It is another object of the present invention to provide a new FURNITURE SUPPORTING SYSTEM which may be easily and efficiently manufactured and marketed.

It is a further object of the present invention to provide a new FURNITURE SUPPORTING SYSTEM which is of a durable and reliable construction.

An even further object of the present invention is to provide a new FURNITURE SUPPORTING SYSTEM which is susceptible of a low cost of manufacture with regard to both materials and labor, and which accordingly is then susceptible of low prices of sale to the consuming public, thereby making such FURNITURE SUPPORTING SYSTEM economically available to the buying public.

Still yet another object of the present invention is to provide a new FURNITURE SUPPORTING SYSTEM which provides in the apparatuses and methods of the prior art some of the advantages thereof, while simultaneously overcoming some of the disadvantages normally associated therewith.

Still another object of the present invention is to provide a new FURNITURE SUPPORTING SYSTEM for supporting a piece of furniture on a wall in a secure manner.

Even still another object of the present invention is to provide a new FURNITURE SUPPORTING SYSTEM that includes a slot structure situated between the piece of furniture and a wall for providing a slot that is elongated in a horizontal direction and has a rectilinear cross-section. Also included is a protrusion structure situated between the piece of furniture and the wall for providing a protrusion that is elongated in the horizontal direction and has a rectilinear cross-section. As such, the elongated protrusion may be removably situated within the elongated slot for supporting the piece of furniture on the wall.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the first mounting assembly of the present invention.

FIG. 2 is a perspective view of the second mounting assembly of the present invention.

FIG. 3 is a perspective view of the spacer of the present invention.

DESCRIPTION OF THE PREFERRED EMBODIMENT

Figure 4:
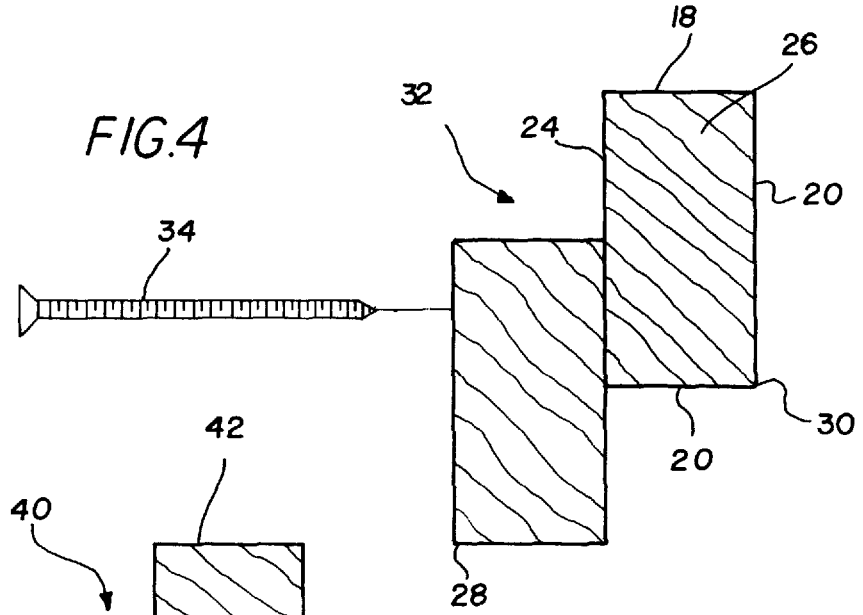
FIG. 4 is a side view of the present invention.

With reference now to the drawings, and in particular to FIGS. 1 through 5 thereof, a new FURNITURE SUPPORTING SYSTEM embodying the principles and concepts of the present invention and generally designated by the reference numeral 10 will be described.

Figure 5:
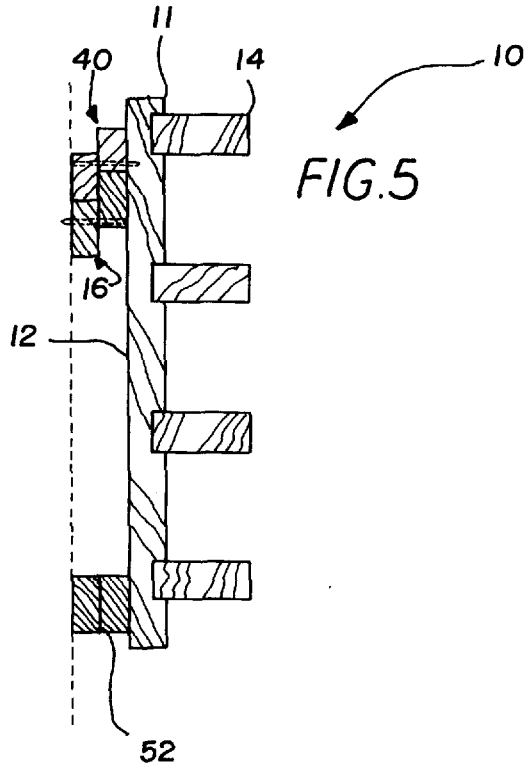
FIG. 5 is a side view of the present invention in use.

The system 10 of the present invention includes a shelf 11 with a vertical back plate. As shown in FIG. 5, the vertical back plate 12 has a front surface and a rear surface with a periphery formed therebetween defined by a top edge, a bottom edge, and a pair of side edges. The shelf further has a plurality of horizontal members 14 coupled to the front surface thereof at different elevations. Such horizontal member extends outwardly to afford a supporting a surface. It should be noted that any piece of furniture having a vertical back plate may be used in the present invention in lieu of the shelf.

As shown in FIG. 1, a first mounting assembly 16 is provided with a pair elongated members. The pair of elongated members each has a rectilinear configuration with a top face 18, a bottom face 20, a front face 22, a rear face 24, and a pair of ends 26. It should be noted that the front and rear face have a height twice a depth of the top and bottom face. The pair of elongated members comprise a first elongated member 28 and a second elongated member 30. The front face of the first elongated member is coupled to the rear face of the second elongated member such that the first elongated member is vertically offset from the second elongated member. Such interconnection defines an upper elongated slot 32 having a square cross-section. The rear face of the first elongated member is screwably coupled to a wall and is horizontally oriented thereon, as shown FIG. 5. Ideally, a plurality of screws 34 are drilled through the lower extent of the second elongated member and an upper extent of the first elongated member to accomplish this.

Associated therewith is a second mounting assembly 40 including a pair of elongated members 42 each having a rectilinear configuration. Note FIG. 2. Similar to the elongated members of the first mounting assembly, each has a top face, a bottom face, a front face, a rear face, and a pair of ends. Further, the front and rear face have a height twice a depth of the top and bottom face. The pair of elongated members comprise a first elongated member 44 and a second elongated member 46 with the front face of the first elongated member coupled to the rear face of the second elongated member. As shown in the Figures, the first elongated member is vertically offset from the second elongated member thereby defining an elongated downwardly extending protrusion 48 having a square cross-section. The front face of the second elongated member is screwably coupled to the rear surface of the back plate of the shelf and is horizontally oriented thereon. In the preferred embodiment, a plurality of screws 50 are drilled through the lower extent of the second elongated member and an upper extent of the first elongated member.

By this structure, the elongated protrusion of the second mounting assembly may be removably situated within the elongated slot of the first mounting assembly for supporting the shelf on the wall. The weight of the shelf is thus evenly distributed along the entire lengths of the mounting assemblies and securely fastened to the wall. This is especially critical in the event of an earthquake. Preferably, each of the elongated members comprises a ½×1 mahogany wood strip or a 1×2 strip of pine.

Finally, an elongated spacer 52 is situated between the rear surface shelf and the wall adjacent the bottom edge thereof. The spacer preferably comprises a pair of elongated members 54 similar to those utilized with the mounting assemblies. The elongated members of the spacer, however, are coupled face-to-face thereby defining a square cross-section.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A furniture supporting system comprising, in combination:

a shelf including a vertical back plate having front surface and a rear surface with a periphery formed therebetween defined by a top edge, a bottom edge, and a pair of side edges, the shelf further having a plurality of horizontal members coupled to the front surface thereof at different elevations and extending outwardly therefrom;

a first mounting assembly including a pair of elongated members each having a rectilinear configuration with a top face, a bottom face, a front face, a rear face, and a pair of ends, the front and rear face having a height twice a depth of the top and bottom face, the pair of elongated members comprising a first elongated member and a second elongated member with the front face of the first elongated member coupled to the rear face of the second elongated member such that the first elongated member is vertically offset from the second elongated member thereby defining an upper elongated slot having a square cross-section, whereby the rear face of the first elongated member is screwably coupled to a wall and is horizontally oriented thereon;

a second mounting assembly including a pair of elongated members each having a rectilinear configuration with a top face, a bottom face, a front face, a rear face, and a pair of ends, the front and rear face having a height twice a depth of the top and bottom face, the pair of elongated members comprising a first elongated member and a second elongated member with the front face of the first elongated member coupled to the rear face of the second elongated member such that the first elongated member is vertically offset from the second elongated member thereby defining an elongated downwardly extending protrusion having a square cross-section, whereby the front face of the second elongated member is screwably coupled to the rear surface of the back plate of the shelf and is horizontally oriented thereon, whereby the elongated protrusion of the second mounting assembly may be removably situated within the elongated slot of the first mounting assembly for supporting the shelf on the wall; and an elongated spacer situated between the rear surface shelf and the wall adjacent the bottom edge thereof.

2. In combination, a piece of furniture and a furniture supporting assembly, the furniture supporting assembly comprising:

a first mounting assembly including a pair of elongated members each with a top face, a bottom face, a front face, a rear face, and a pair of ends, the pair of elongated members comprising a first elongated member and a second elongated member with the front face of the first elongated member coupled to the rear face of the second elongated member such that the first elongated member is vertically offset from the second elongated member thereby defining an upper elongated slot, whereby the rear face of the first elongated member is coupled to a wall and is horizontally oriented thereon; and a second mounting assembly including a pair of elongated members each with a top face, a bottom face, a front face, a rear face, and a pair of ends, the pair of elongated members comprising a first elongated member and a second elongated member with the front face of the first elongated member coupled to the rear face of the second elongated member such that the first elongated member is vertically offset from the second elongated member thereby defining an elongated downwardly extending protrusion, whereby the front face of the second elongated member is coupled to the piece of furniture and is horizontally oriented thereon, whereby the elongated protrusion of the second mounting assembly may be removably situated within the elongated slot of the first mounting assembly for supporting the piece of furniture on the wall.

3. A furniture supporting assembly as set forth in claim 2 wherein an elongated spacer is situated between the wall and a rear surface of the piece of furniture adjacent a bottom edge thereof.

4. A furniture supporting assembly as set forth in claim 2 wherein the front face and the rear face of each elongated member has a height twice a depth of the top face and the bottom face thereof.

* * * * *